US005705822A

United States Patent [19]

Su

[11] Patent Number: 5,705,822

[45] Date of Patent: Jan. 6, 1998

[54] COOLING SYSTEM FOR SEMICONDUCTOR PROCESS

[75] Inventor: Kr-Zu Su, Chiayi, Taiwan

[73] Assignee: Vanguard International Semiconductor Corporation, Hsinchu, Taiwan

[21] Appl. No.: 791,506

[22] Filed: Jan. 30, 1997

[51] Int. Cl.[6] ..... B05D 3/06

[52] U.S. Cl. ..... 250/492.1; 250/504 R

[58] Field of Search ..... 250/492.1, 492.2, 250/493.1, 504 R, 443.1

[56] References Cited

U.S. PATENT DOCUMENTS 4,864,145 9/1989 Burgio, Jr. ..... 250/492.1

*Primary Examiner*—Kiet T. Nguyen

*Attorney, Agent, or Firm*—Christensen O'Connor Johnson & Kindness PLLC

[57] ABSTRACT

A cooling system for use in a UV curing apparatus is disclosed. The cooling system includes a UV curing apparatus and a water supply element connected to the UV curing apparatus for cooling the curing apparatus via a first solenoid valve. A CPU is responsive to the UV curing apparatus for controlling the status of the first solenoid valve. An inverter is connected to the CPU and its output is coupled to a second solenoid valve. The second solenoid valve connects an air purging element to the curing apparatus. The air purging element provides clean dry air to force the water out of the curing apparatus.

6 Claims, 1 Drawing Sheet

COOLING SYSTEM FOR SEMICONDUCTOR PROCESS

TECHNICAL FIELD OF THE INVENTION

The present invention relates to a cooling system, and more particularly, to a cooling system for a semiconductor process.

BACKGROUND OF THE INVENTION

Along with the trend for higher device density in semiconductor ICs, the requirements for the controlling of semiconductor process conditions have become stricter. Namely, in VLSI fabrication, the accurate control of layer thickness, reaction temperature, and pressure are more important than ever to the reduction of defects. Many semiconductor process materials such as spin on glass, metal, etc. that are used in semiconductor processes need to undergo a curing process after these materials are formed on the semiconductor wafer. Typically, the curing process is carried out in a UV curing apparatus.

FIG. 1 shows in schematic form a conventional cooling system for a UV curing apparatus. The curing apparatus 1 used to perform the curing process includes a magnetron and a reflector to generate UV radiation for curing the material. Generally, heat will be generated by the magnetron and the reflector during the curing process. Typically, a water jacket is set on the reflector for cooling the curing apparatus 1. In order to achieve this, deionized water is supplied by a water supply 3. The water supply 3 is connected to the curing apparatus 1 by piping controlled by a solenoid valve 5. A CPU 7 is connected to the valve 5 for controlling the state of the valve 5 in either an "on" or "off" position. If the curing apparatus 1 turns off for more than three minutes, a sensor causes the CPU 7 to shut off the solenoid valve 5. The deionized water then just sits in the curing apparatus 1.

An air purging element 9 is connected to the curing apparatus 1 via a pipe controlled by a manual valve 11. In general, the manual valve 11 is turned off. When an operator desires to drain the deionized water that is sitting in the curing apparatus 1, the manual valve 11 is turned on. Clean dry air is then provided by the air purging element 9 to purge the water out of the curing apparatus 1.

Thus, the deionized water will stay in the curing apparatus 1 while the curing apparatus 1 is not being operated. However, the curing apparatus 1 may often be shut down due to the temperature within the curing apparatus 1 being too high. This is because that the deionized water sits in the curing apparatus 1 causing "water plugging" of the cooling system, which causes the flow rate of the water to be abnormal. Therefore, the temperature in the curing apparatus 1 is raised due to the "water plugging". In addition, the high temperature may cause the photoresist that is patterned over a wafer to reflow over the wafer.

To illustrate the water plugging phenomena, a typical operational sequence of the curing apparatus will be described. First, the power to the curing apparatus 1 is turned on. Then, the solenoid valve 5 is in turned "on" and the deionized water is circulated in the curing apparatus 1. Next, when the curing apparatus 1 is detected to be turned off for more than three minutes due to overheating, a sensor causes the CPU 7 to shut off the solenoid valve 5 in order to stop the cooling system. This results in residual high temperature water sitting in the curing apparatus 1. The residual high temperature water that sits in the curing apparatus 1 will cause "water plugging" of the cooling system. In order to solve the "water plugging" problem is, the water is drained in the curing apparatus 1 by using air purging element 9 to force the water out of the curing apparatus 1.

SUMMARY OF THE INVENTION

A cooling system for use in a semiconductor process is disclosed. The cooling system includes a UV curing apparatus. A water supply element is used to provide deionized water for cooling the curing apparatus. The water supply element is connected to the curing apparatus via a first solenoid valve. A CPU is connected to the solenoid valve for controlling the status of the first solenoid valve. A first node is set between the CPU and the solenoid valve. An inverter is connected to the first node. A second solenoid valve that has three terminals is connected to the inverter via a first terminal. A second terminal of the second solenoid valve is connected to the curing apparatus. An air purging element is connected to the second solenoid valve via a third terminal of the second solenoid valve. The air purging element is used to provide clean dry air to force the water out of the curing apparatus. A third solenoid valve that is set between the curing apparatus and the inverter via a second node. The second node is set between the inverter and the second solenoid valve.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
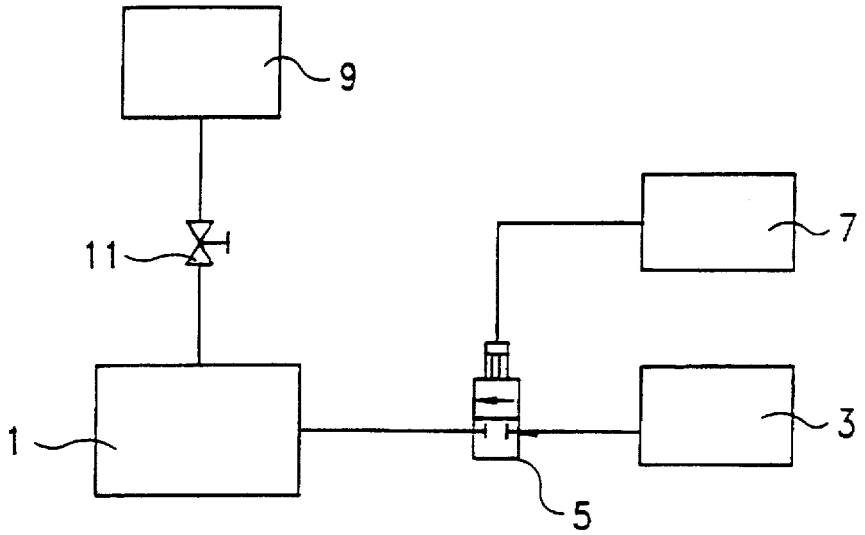
FIG. 1 (PRIOR ART)
FIG. 1 shows in schematic form a conventional cooling system for a curing apparatus.
Figure 2:
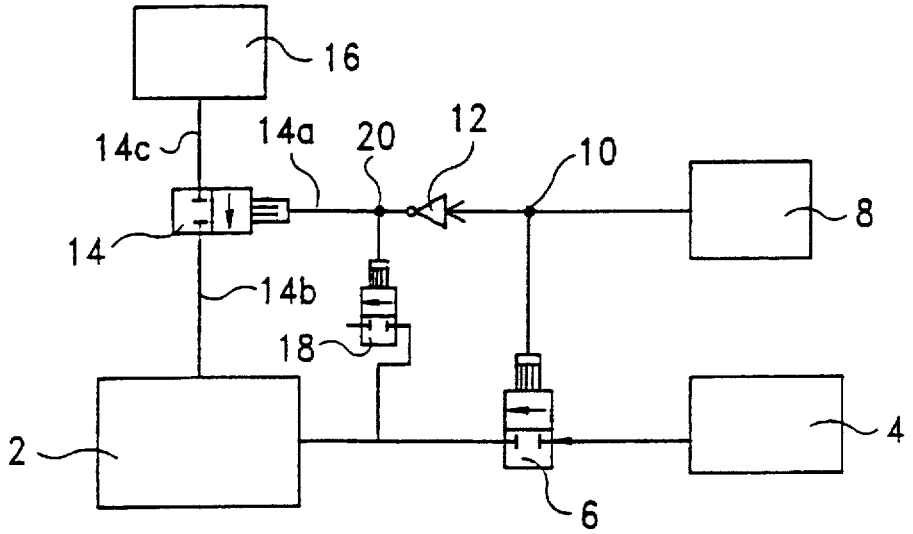
FIG. 2 shows in schematic form a cooling system of the present invention for a curing apparatus.

FIG. 2 shows a cooling system for a UV curing apparatus formed in accordance with the present invention. The curing apparatus 2 used to perform the curing process includes a magnetron and a reflector to generate UV radiation for curing material used in common semiconductor processes, such as spin on glass, metal, etc. Like the prior art, a water supply element 4 is used to provide deionized water to a water jacket that is set on the reflector for cooling the curing apparatus 2. The water supply element 4 is connected to the curing apparatus 2 via a pipe controlled by a first solenoid valve 6.

A CPU 8 is connected to the valve via a node 10 for controlling the status of first solenoid valve 6 into either an 'on' or an 'off' position. A node is set between the CPU 8 and the solenoid valve 6. If the curing apparatus 2 turns off for more than three minutes, a sensor causes the CPU 8 to shut off the first solenoid valve 6. An inverter 12 is connected to the node 10. Typically, the curing apparatus 2 is in operating status, and thus, the inverter 12 produces an 'off' output.

A second solenoid valve 14 is connected to the inverter 12 via a first terminal **14*a*. The second solenoid valve 14 sits in piping between an air purging element 16 and the curing apparatus 2. A second terminal 14*b* of the second solenoid valve 14 is connected to the curing apparatus 2. The air purging element 16 is connected to the second solenoid valve 14 via a third terminal 14*c* of the second solenoid valve 14. The air purging element 16 is used to provide clean dry air to force the water out of the curing apparatus 2**.

Namely, while the power of the curing apparatus 2 is shut down, the first solenoid valve 6 is 'off' and the output from inverter 12 is 'on'. The second solenoid valve 14 is responsive to the 'on' signal of the inverter 12 to turn on the second solenoid valve 14.

Subsequently, clean dry air flushes through the cooling system, forcing the residual water out of the cooling system via a drain valve 18. In the preferred embodiment, the drain valve 18 is a third solenoid valve 18 that is set between the curing apparatus 2 and the inverter 12 via a node 20. The node 20 is set between the inverter 12 and the second solenoid valve 14. Similarly, when the curing apparatus 2 is in the status of operation, the third solenoid valve 18 is 'off'. Similarly, when the curing apparatus 2 is turned off, the third solenoid valve 18 is 'on'.

To illustrate the operation of the system of the present invention, a typical operational sequence of the curing apparatus will be described. First, curing apparatus 2 is turned on. The first solenoid valve 6 is in the 'on'position and deionized water is circulating in the curing apparatus 1 for cooling. Further, both the second solenoid valve 14, the third solenoid valve 18 are in the off' position. Next, if it is sensed that the curing apparatus 2 is turned off for more than three minutes due to overheating, a sensor causes the CPU 8 to shut off first the solenoid valve 6. At the same time, the second solenoid valve 14 and the third solenoid valve 18 are turned on simultaneously. As a result, clean dry air is provided by the air purging element 16 to force the water in the curing apparatus 2 out of the curing apparatus 2 and through drain 18.

The benefits of the present invention are that the water plugging problem is solved. The operation of the present invention is that no water sits in the cooling system while the curing apparatus 2 is shut down. Further, the water in the curing apparatus 2 is automatically drained out of the cooling system while the curing apparatus 2 is turned off. In the prior art, water plugging problems occur about once every 2 to 3 days, while the cooling system of the present invention will experience no water plugging.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A cooling system for a curing apparatus used in a semiconductor process, said curing apparatus including a magnetron and a reflector for generating radiation, said cooling system comprising:

a water supply element connected to said curing apparatus for supplying cooling water to said curing apparatus;

a first solenoid valve located between said water supply element and said curing apparatus, said first solenoid valve allowing said cooling water to flow when set to an on position;

an air purging element connected to said curing apparatus for providing a gas to force said cooling water out of said curing apparatus;

a second solenoid valve located between said air purging element and said curing apparatus, said second solenoid valve allowing said gas to flow when set to an on position; and a CPU for controlling the first and second solenoid valves, said CPU setting said first solenoid valve in said on position and said second solenoid valve in an off position when said curing apparatus is operating and setting said first solenoid valve in an off position and said second solenoid valve in said on position when said curing apparatus is not operating.

2. The system of claim 1 further comprising:

a third solenoid valve connected to said curing apparatus and a drain, said third solenoid valve being in an on position when said second solenoid valve is in said on position and being in an off position when said second solenoid valve is in said off position.

3. The system of claim 2 wherein said gas is clean dry air.

4. The system of claim 1 wherein said gas is clean dry air.

5. The system of claim 1 wherein said cooling water is deionized water.

6. The system of claim 1 wherein said curing apparatus is a UV curing apparatus.

* * * * *